United States Patent [19]

Erickson

[11] Patent Number: 4,756,731

[45] Date of Patent: Jul. 12, 1988

[54] OXYGEN AND ARGON BY BACK-PRESSURED DISTILLATION

[76] Inventor: Donald C. Erickson, 1704 So. Harbor La., Annapolis, Md. 21401

[21] Appl. No.: 831,183

[22] Filed: Feb. 20, 1986

[51] Int. Cl.[4] ..... F25J 3/04

[52] U.S. Cl. ..... 62/22; 62/28; 62/32; 62/39; 62/42

[58] Field of Search ..... 62/22, 23, 24, 28, 30, 62/31, 42, 29, 38, 39, 11

[56] References Cited

U.S. PATENT DOCUMENTS

| | | | |
|---|---|---|---|
| 2,699,046 | 1/1955 | Etienne | 62/29 |
| 2,934,907 | 5/1960 | Soofield | 62/22 |
| 2,934,908 | 5/1960 | Latimer | 62/22 |
| 3,500,651 | 3/1970 | Becker | 62/29 |
| 3,688,513 | 9/1972 | Stretch | 62/22 |
| 4,254,629 | 3/1981 | Olszewski | 62/29 |
| 4,433,989 | 2/1984 | Erickson | 62/22 |
| 4,507,134 | 3/1985 | Tomisaka | 62/30 |

*Primary Examiner*—Ronald C. Capossela

[57] ABSTRACT

In a triple pressure cryogenic air distillation apparatus for producing of high purity oxygen and crude argon at low energy requirement, a novel method of avoiding proximity to argon freezeup conditions is disclosed. Referring to FIG. 3, the temperature at the overhead of the argon recovery column 309 is kept above about −305° F. by increasing the pressure of $N_2$ rejection column 304 to about 3 psi above normal discharge pressure. The exhaust $N_2$ is subsequently depressurized in one or more work-expanders 324 and 330 thereby producing process refrigeration.

16 Claims, 3 Drawing Sheets

OXYGEN AND ARGON BY BACK-PRESSURED DISTILLATION

DESCRIPTION

1. Technical Field

The invention relates to processes and apparatus for industrial separation of air into oxygen of medium to high purity (>98%) and crude argon byproduct by cryogenic distillation. The disclosed improvement achieves the high energy efficiency characteristic of modern triple distillation pressure flowsheets while eliminating the argon freezeup problem normally associated with these processes.

2. Background Art

There has been a continuing search for cryogenic air distillation flowsheets capable of producing high purity oxygen plus argon byproduct at air supply pressures lower than the 95 psia (6.46 atmospheres absolute) characteristic of conventional dual pressure column flowsheets. The conventional dual pressure configuration with argon side-arm is illustrated by U.S. Pats. Nos. 2,934,908 and 2,934,907, plus the journal article "Distillation of Air" by R. E. Latimer, Chemical Engineering Progress Vol. 63 No. 2, February 1967, page 39.

If the nitrogen rejection column (the lower pressure column) of the conventional configuration is reboiled by condensing air rather than condensing $N_2$, much lower air supply pressures are possible. However, high oxygen recovery requires a large amount of liquid nitrogen ($LN_2$) reflux at the top of the $N_2$ rejection column, hence most of the air must go to the HP rectifier to produce that $LN_2$. Similarly, high purity requires high vapor rates through the argon stripper. These conflicting demands were first satisfied by the flowsheet disclosed in U.S. Pat. No. 3,688,513. In that flowsheet, the $N_2$ rejection column is reboiled by a minimum amount of condensing air, with the remainder being supplied to the HP rectifier. The HP rectifier overhead provides some reboil to an intermediate height of the $N_2$ rejection column and also reboils a third column which is at lower pressure than the $N_2$ rejection column. This LP column is supplied from a sidestream liquid withdrawn from the $N_2$ rejection column comprised of oxygen and argon. Argon stripping is done at the bottom of both the LP column and the $N_2$ rejection column in proportion to the reboil through each stripping section.

Although both good recovery and good purity are obtained, this flowsheet unfortunately does not recover crude argon. Thus the 8 to 12% savings in energy is offset by the lack of crude argon coproduct, which is usually 5 to 10% of the total product value.

The reason the above triple pressure flowsheet cannot recover crude argon is that the LP column only supplies reboil to the $N_2$ rejection column at a single height. The amount of reboil supplied from the HP column directly to the $N_2$ rejection column intermediate height must be limited in order to obtain sufficient argon stripping reboil. Thus additional $N_2$ rejection column reboil is necessary before much concentration and temperature change is incurred, to avoid "pinching out". If the LP column effects the separation all the way from high purity oxygen at the bottom to crude argon (>90%) at the top, it experiences a temperature differential of 8° to 12° F. (4.5K to 6.7K differential). Thus the top of such an argon (LP) column is not warm enough to provide $N_2$ rejection column reboil at the necessary height to prevent pinchout. The LP column of U.S. Pat. No. 3,688,513 flowsheet must have low purity argon at the top, e.g., 20 to 50% purity, to provide reboil adequately warm for the $N_2$ rejection column. If this vapor were withdrawn as byproduct or as waste, it would represent a serious loss of oxygen product (lower recovery). Accordingly, the flowsheet incorporates a liquid recycle pump to return the LP column overhead product to the $N_2$ rejection column. Unfortuantely this introduces other undesirable consequences—the argon levels in both columns are forced up by the recycle sufficiently to force most of the argon out of the $N_2$ rejection column overhead. This substantially increases the required number of argon stripping trays in each column, and increases column pressure drops.

Thus there are two requirements which are very difficult to meet simultaneously but both of which are essential to producing high purity oxygen at high recovery: sufficient $LN_2$ reflux and sufficient argon stripper reboil. Quantitatively, for every 100 moles of compressed air supplied to the cold box, it is necessary to have at least about 30 moles of $N_2$ overhead product at the HP rectifier and at least about 50 moles of reboil through the argon stripper(s), in order to achieve at least 95% recovery of available oxygen at at least 99.5% purity.

Both the method of producing process refrigeration and the method of gasifying the product oxygen also can have substantial impact on the amount of available argon stripper reboil. In the above cited U.S. Pat. No. 3,688,513, refrigeration is produced by work-expanding about 13% of the supply air directly to the $N_2$ rejection column. This air provides neither argon stripper reboil nor HP rectifier $N_2$. The LOX is gasified at the base of the LP column, by latent heat exchange with HP rectifier overhead $N_2$. Thus the fraction of supply air which ultimately gasifies the LOX is useful in producing $LN_2$, but not in argon stripping.

In U.S. Pat. No. 4,507,134, two modifications to the above triple pressure flowsheet are disclosed. First, crude argon is withdrawn from the LP column overhead by a vacuum compressor. As explained above, this unavoidably means that either the crude argon has very large $O_2$ content, reducing recovery, or there must be a large transfer of reboil from the HP rectifier overhead to $N_2$ rejection column intermediate height, bypassing the LP column, which reduces recovery, purity, or both. An even greater difficulty is introduced by the means for LOX gasification: a fraction of the supply air is first partially condensed to reboil the $N_2$ rejection column bottom, and then the residue is totally condensed to gasify the LOX. This produces a large quantity of quite impure $LN_2$, e.g., with 13% $O_2$ content, and greatly reduces the HP rectifier overhead $N_2$. Also the average $O_2$ content of the condensing gas which reboils the $N_2$ rejection column is somewhat lower, requiring a slightly higher air supply pressure. The LOX is gasified at a somewhat higher pressure than in the first flowsheet, and the LOX is pressurized by the conventional practice of using the hydrostatic head. However, the drawbacks incurred for the higher $O_2$ pressure and crude argon withdrawal are greatly reduced recovery plus possibly some loss in purity.

In copending U.S. Pat. No. 4,605,427 filed June 6, 1983 by the present applicant, a solution is disclosed to the problem of producing crude argon while maintaining adequate reflux $LN_2$ and argon stripper reboil to permit high recovery at high purity. The solution is to have at least two transfers of reboil from the LP column to the MP column, at vertically spaced tray heights. Thus the maximum amount of reboil traverses the argon stripping section of the LP column, and then part is transferred to the MP column and only a reduced amount continues up the LP column to establish crude argon purity.

In addition to that basic and generally applicable disclosure, the above application also discloses a means for substantially increasing the argon stripper reboil. That is done by gasifying the LOX by latent heat exchange with LP column intermediate height vapor. Thus the supply air which ultimately gasifies the LOX contributes to both $LN_2$ reflux production and argon stripper reboil. The increase in argon stripper reboil is so substantial that the separate argon stripper at the base of the $N_2$ rejection column is no longer necessary, and hence lower air supply pressure is possible. Also, much higher $O_2$ purities are obtainable. The drawback incurred is the lower $O_2$ delivery pressure, on the order of 0.6 ATA.

In a second copending U.S. Pat. No. 4,578,095, filed Aug. 20, 1984 by the present applicant, a triple pressure flowsheet is disclosed which gasifies LOX at the HP rectifier overhead; has two argon stripping sections; and has at least two transfers of reboil from the LP column to the $N_2$ rejection column, whereby crude argon of acceptable purity and recovery (e.g., >80% purity and >50% recovery) is coproduced in addition to high purity oxygen at high recovery (>99.5% purity, >95% recovery).

In order to achieve full value from the crude argon byproduct, it should be as pure as possible. Otherwise the purification cost is too high, consuming hydrogen and requiring added equipment. When the crude argon purity of the three prior art disclosures described above is increased, a new problem arises. Pure liquid argon freezes at about −308.6° F., and also at a pressure below 10.7 psia. The temperature at the overhead of the LP column is established by the temperature of that height of the $N_2$ rejection column to which the reboil is transferred. Note that reboil can be transferred either via indirect latent heat exchange with $N_2$ rejection column liquid or via latent heat exchange with kettle liquid which is then fed into the $N_2$ rejection column. In a modern well designed configuration with $N_2$ rejection column overhead pressure and temperature at about 17 psia and −318° F. respectively, the kettle liquid has a bubble temperature of −313° F., and the temperature of the $N_2$ rejection column height which receives reboil from the LP column overhead is in the −307° to −310° F. range. Even if the argon is kept above 12 psia, corresponding to −306° F., local cold spots in the condenser could cause localized freezing, which once started could become progressively worse, causing serious upsets.

What is needed is a new process or apparatus which retains the advantages of the flowsheets disclosed in U.S. Pat. Nos. 4,605,427 and 4,578,095: high purity and recovery of both oxygen and crude argon, all at substantially reduced supply air pressure; but which avoids the unacceptable proximity to argon freezeup conditions. That is the primary objective of the newly disclosed process herein.

DISCLOSURE OF INVENTION

The disadvantages of the prior art are overcome by providing a triple pressure air distillation process or apparatus in which: the MP column bottom is reboiled by partial or total condensation of at least part of the supply air; the LP column bottom is reboiled by HP rectifier overhead product; at least one intermediate height of the MP column receives reboil from the LP column by at least one of latent heat exchange with MP column liquid or latent heat exchange with kettle liquid which is then fed to the MP column; product purity oxygen is withdrawn from the LP column bottom, and crude argon is withdrawn from the LP column overhead; and in which the unique feature is the back pressuring of the MP column whereby overhead $N_2$ is withdrawn at a pressure at least about 0.15 ATA (3 psi) above the normal withdrawal pressure and is work expanded to supply the required process refrigeration.

Beyond the basic inventive entity as defined above or in the claims, numerous variations are possible in regard to particular features incorporated to achieve a desired product mix or conform to local conditions. For example, with the above described process the expander flow does not bypass the HP rectifier, and hence increased $LN_2$ reflux is available. One means of capitalizing on this extra availability is to gasify the LOX via condensing air in lieu of via HP rectifier overhead. This increases the $O_2$ delivery pressure. The liquid air thus made available to reflux the MP column reduces the $LN_2$ requirement, such that the added increment obtained from what normally goes to the HP expander is sufficient to retain full $O_2$ recovery.

Since essentially all of the $N_2$ is routed through the expander, only a very small pressure ratio is necessary. The MP column will be about 4 to 5 psi higher than normal pressure, and the air supply pressure must be increased by about 10 to 15 psi. This will still be about 15 psi lower than conventional high purity LOXBOIL plants require, and the $O_2$ delivery pressure will be close to that found in LOXBOIL plants.

In other circumstances, where significant amounts of co-product high purity $N_2$ are required, the preferred configuration would be to gasify the LOX in the LP column bottom, i.e., withdraw it in gaseous phase rather than liquid phase, and use the extra $LN_2$ to achieve the required $N_2$ purity.

Even though crude argon is withdrawn, it will not necessarily be a product, depending on local market conditions, i.e., it may simply be vented. In the backpressured configuration, it is possible to keep the LP column overhead above atmospheric pressure, such that no argon compressor is required for withdrawal. When routing to further purification, it is normally further pressurized regardless of withdrawal pressure. The backpressured configuration raises all column temperatures by about 3° F., providing that much added margin to argon freezeup. All column pressures are about 20% higher, thus reducing column volumes somewhat. The costs of these advantages are a physically larger expander and a higher air supply pressure compared to non-backpressured triple pressure configurations.

BEST MODE FOR CARRYING OUT THE INVENTION

Figure 1:
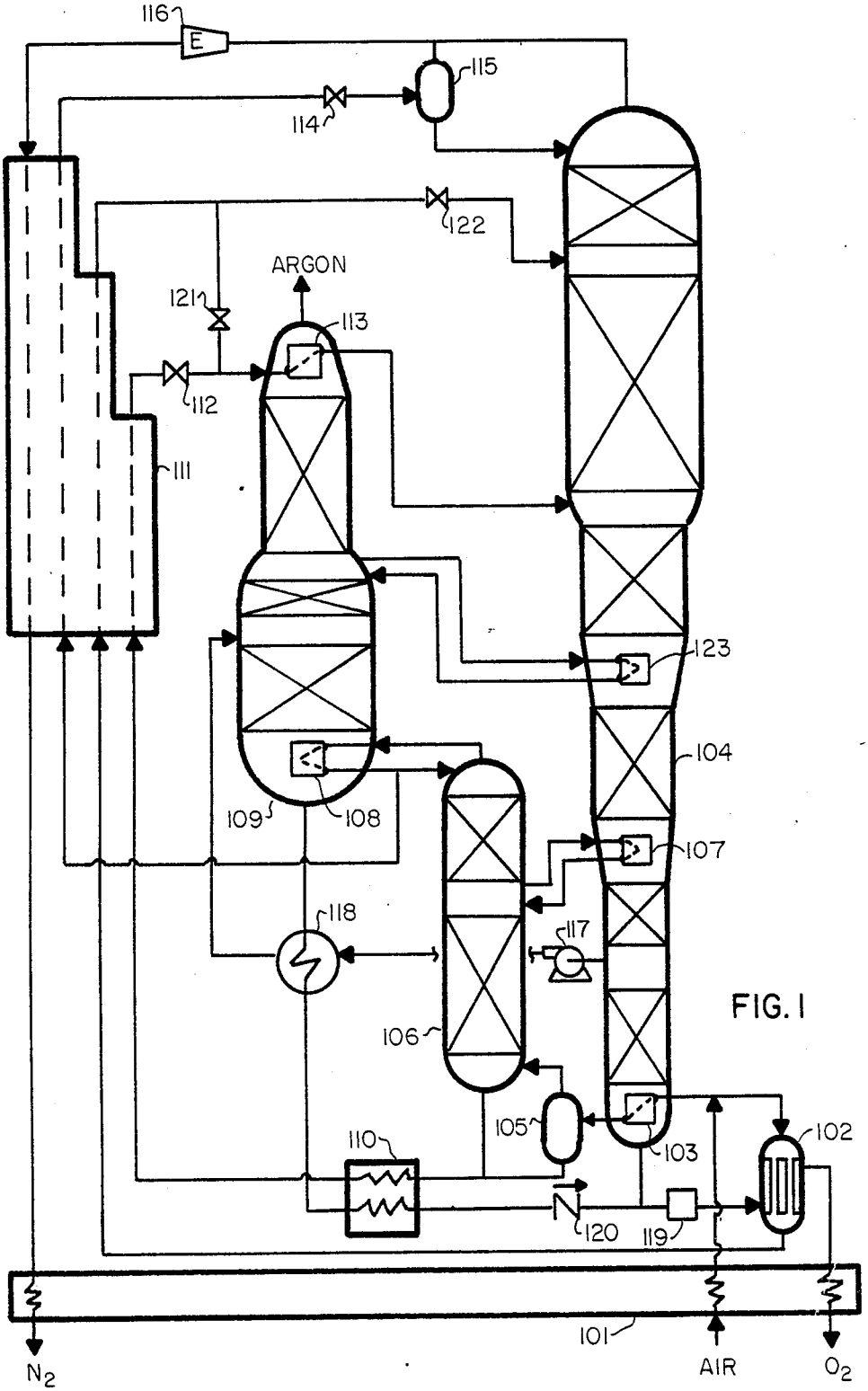
FIG. 1, the preferred or most representative embodiment of flowsheet which embodies the essential aspects of the disclosed invention, is a simplified flowsheet of a triple pressure air distillation arrangement incorporating backpressured expansion of MP column nitrogen; LOXBOIL by total condensation of supply air; two vertically spaced transfers of reboil from LP to MP; two argon stripping sections; crude argon withdrawal; plus a liquid air split which makes it possible for part of the liquid air to join the kettle liquid in refluxing the LP column overhead.

Referring to FIG. 1, air which has been compressed to a supply pressure normally in the range of 4.6 to 5.6 ATA and cleaned and dried is cooled to near its dewpoint in main exchanger 101, at an example flowrate of 1000 gram-moles/second ("m"). It is then split, with 260 m being directed to LOX gasifier 102 and the remainder to bottoms reboiler 103 of $N_2$ rejection column (MP column) 104. Separator 105 removes the condensed fraction and routes the remaining vapor to HP rectifier 106. The HP rectifier receives intermediate reflux from intermediate reboiler 107 of the MP column. Overhead reflux is from reboiler 108 of LP column 109. Kettle liquid from 105 and 106 is subcooled in sensible heat exchangers 110 and 111, then reduced in pressure in 112 and routed to LP column overhead refluxer 113, where it is partially evaporated, then fed to MP column 104. $LN_2$ overhead from HP rectifier 106 is subcooled in 111, reduced in pressure in 114, and after optional phase separation in 115 the liquid is introduced as reflux into 104 overhead. Gaseous $N_2$ is expanded in 116 and then provides cooling to incoming fluids in subcooler 111 and main exchanger 101 before being discharged, vented, or otherwise utilized (e.g., sieve regeneration). LP column 109 feed is a side withdrawal liquid stream from MP column 104 taken from just above the argon stripping section. Although the LP column pressure is slightly lower than that of the MP column, the column elevations and resulting liquid hydrostatic heads will normally require that pump 117 be used for this transfer. Some subcooling is desirable, e.g., in subcooler 118, before feeding to 109. The liquid bottom from column 109 is warmed in 118 and 110, combined with column 103 liquid bottom product, raised to gasification pressure, and gasified in 102. Component 119, when present, may be the means for pressure adjustment and/or a hydrocarbon cleanup device such as molecular sieve. The elevations and hydrostatic heads will determine the need for check valves such as 120 to prevent backflooding of either column. The liquid air from 102 is subcooled in 111 and then split by the combined action of means for pressure reduction 121 and 122. Sufficient liquid air is routed through 121 to maintain both the desired temperature and liquid composition of the partially evaporated stream exiting refluxer 113. Argon is withdrawn from column 109 overhead for further processing, and product purity gaseous $O_2$ is withdrawn from 102 and delivered through 101. Latent heat is exchanged from an intermediate height of LP column 109 above the feed point to an intermediate height of MP column 104 below the feed point by latent heat exchanger 123.

As example and representative operating conditions for FIG. 1, 1000 m air enters 101 at 80 psia and exits at 78.5 psia. 260 m condenses at −285.2° F., gasifying 204 m of 99.5% $O_2$ at 25.3 psia. 135 m of the remainder condenses in 103, causing 117 m reboil up the MP argon stripper. The remaining 605 m of uncondensed air is routed to the HP rectifier 106, having overhead pressure 76.5 psia. 298 m of kettle liquid is combined with 135 m liquid from 105 and routed to 113. 307 m of $LN_2$ is routed via 114 to column 104 overhead. Column 104 has bottom pressure of 26.5 psia, overhead pressure of 22.3 psia, and overhead temperature of −313.6° F. 260 m liquid air from 102 is split and part routed through 121 so as to maintain the partially evaporated fluid exiting 113 at −304° F. and at 50% $O_2$ in the liquid phase. LP column 109 has 20 psia bottom pressure 15.2 psia overhead pressure at −301.3° F., and 6.1 m of crude argon at 92% purity is withdrawn overhead. The backpressured $N_2$ drops about 8° F. in temperature through the expander, and helps minimize $LN_2$ flashing by providing full subcooling. The MP column reboil is increased by about 90 m at 107, and the LP column reboil is decreased by about 140 m at 123. 154 m of liquid oxygen is withdrawn from 109, and combined with 50 m withdrawn from 104 for gasification. 160 m of sidestream liquid $O_2$ containing about 4.3% argon is pumped by 117.

Figure 2:
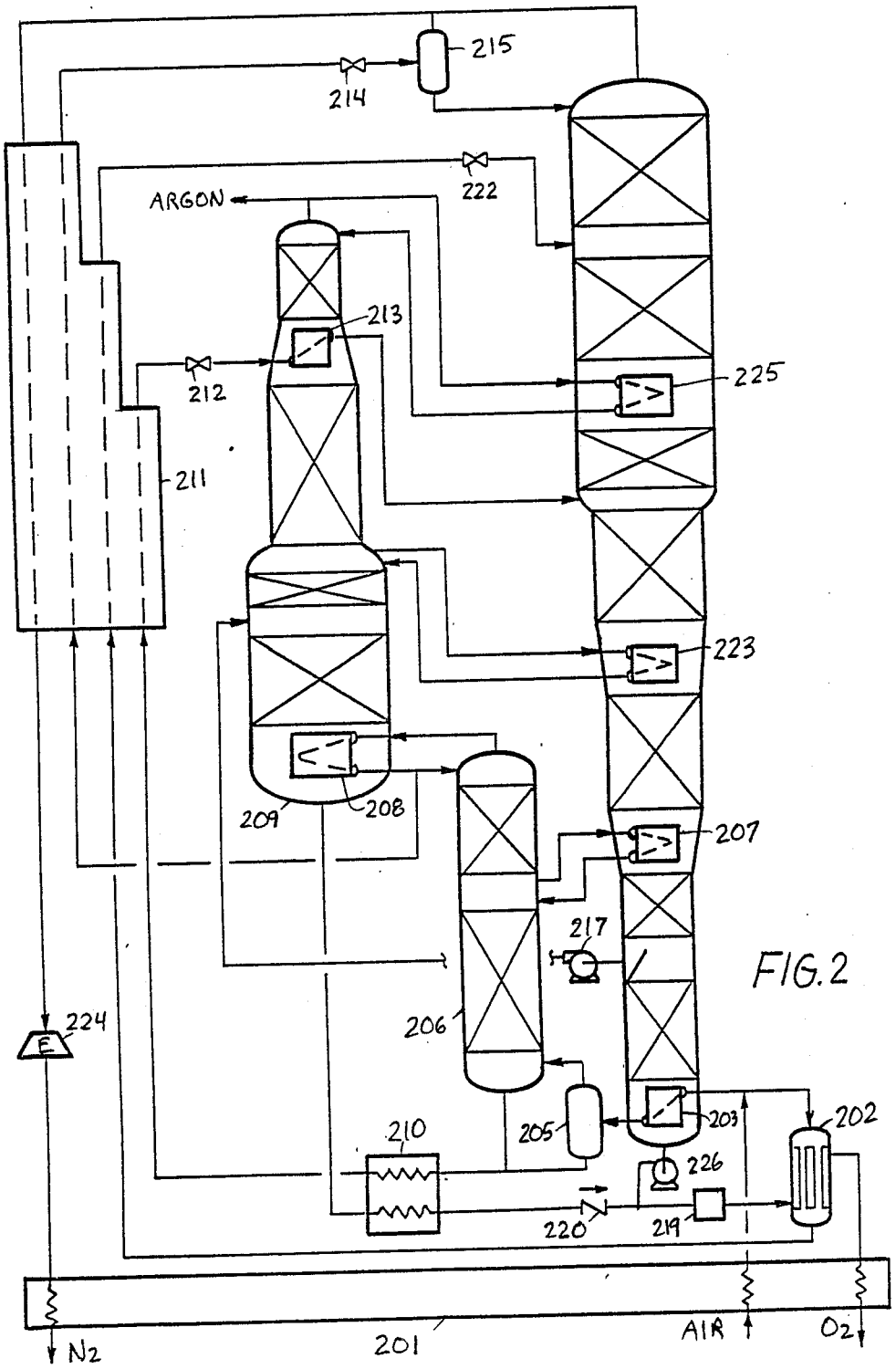
FIG. 2 illustrates a different location of the discharge $N_2$ expander and a triple transfer of reboil from LP to MP column.
Figure 3:
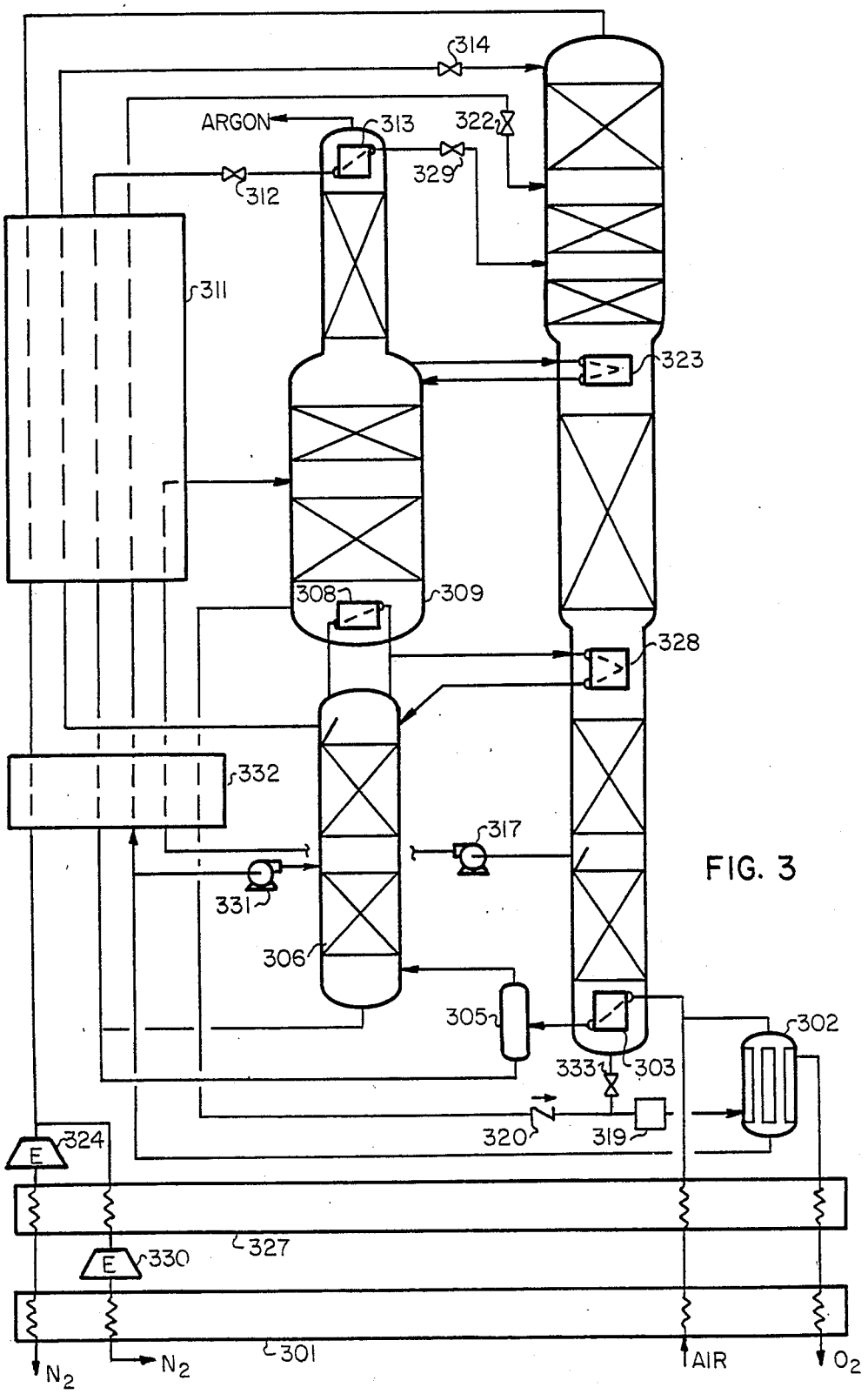
FIG. 3 illustrates a different sensible heat exchange arrangement, a different liquid air split, a different expansion arrangement involving two expanders, and a small latent heat exchange from HP rectifier overhead to MP column intermediate height.

In FIGS. 2 and 3 components having function or description corresponding to components of FIG. 1 have the same number in the 200 series or 300 series respectively, and will not be further described.

In FIG. 2, expander 224 is located at a warmer location than corresponding expander 116. This requires lower pressure ratio drop, but results in more loss of $LN_2$ to flashing. Three latent heat exchanges are pictured between the LP column and MP column, with latent heat exchanger 225 providing the new third one. This largely eliminates the advantages from a liquid air split, which accordingly is eliminated. LOX pump 226 is pictured as it might be required if hydrostatic head is insufficient to pressurize MP column liquid bottom product.

In FIG. 3, the main exchanger is illustrated having two cores, 301 and 327. Two expanders, 324 and 330, operate at different temperatures. MP intermediate height reboil is supplied from HP rectifier overhead vice intermediate height, via exchanger 328. Optional pressure control valve 329 guards against excessive depressurization of 313. Liquid air is split into two direct injection streams, one being pumped to the HP rectifier via pump 331 and the other conventionally to the MP column. A different subcooling arrangement is pictured, incorporating exchanger 332. MP column bottom liquid withdrawal is controlled by valve 333.

Obviously all possible combinations of desirable features have not been pictured, but rather only a few representative ones. LOX can be gasified at the LP column bottoms, by HP rectifier overhead, or by LP column intermediate height liquid. The argon stripping section of the MP column can be omitted, with bottom liquid routed to the LP column. Additional embodiments are possible within the scope of the claimed invention.

I claim:

1. A process for producing oxygen of at least about 98% purity and optionally also crude argon from air at a supply pressure of between about 4.6 and 5.6 ATA in a triple pressure distillation apparatus comprised of a high pressure (HP) rectifier, a medium pressure (MP) nitrogen rejection column, and a low pressure (LP) argon recovery column, comprising:

(a) at least partially condensing at least part of the supply air to supply bottom reboil to the MP column;

(b) exchanging latent heat from the HP rectifier overhead to the LP column bottoms;

(c) exchanging latent heat from the LP column to at least one intermediate height of the MP column;

(d) withdrawing gaseous $N_2$ overhead product from the MP column at a pressure which is at least about 0.15 ATA above the discharge pressure;

(e) work expanding said gaseous $N_2$ product; and (f) withdrawing product purity oxygen from the LP column bottoms, and crude argon from the LP column overhead.

2. Process according to claim 1 further comprising stripping argon from product purity $O_2$ liquid in both the MP column and LP column bottom sections, and transferring liquid sidestream from the MP column above the argon stripping section to the LP column.

3. Process according to claim 1 further comprising transferring MP column liquid bottom product to the LP column, and stripping argon from product purity lqiuid oxygen only in the LP column.

4. Process according to claim 1 further comprising gasifying product purity liquid oxygen by latent heat exchange with a totally condensing fraction of the supply air.

5. Process according to claim 4 further comprising splitting the liquid air, supplying part to reflux an MP column intermediate height, and combining the remainder with kettle liquid for refluxing the LP column overhead.

6. Process according to claim 1 further comprising gasifying product purity liquid oxygen by latent heat exchange with partially condensing air.

7. Process according to claim 1 further comprising gasifying product purity liquid oxygen by latent heat exchange with HP rectifier overhead vapor.

8. Process according to claim 1 further comprising exchanging latent heat from HP rectifier intermediate height to MP column intermediate height which is below the feed point.

9. Process according to claim 1 further comprising exchanging latent heat from an intermediate height of the LP column above the argon stripping section to an intermediate height of the MP column.

10. Process according to claim 1 further comprising compressing supply air to a pressure between 4.6 and 5.6 ATA, withdrawing oxygen of at least 99% purity and 94% recovery at a pressure of at least 1.4 ATA, and recovering at least 50% of the argon at at least 80% purity.

11. Apparatus comprising means designed for distilling air to oxygen of at least 98% purity including:

a. HP rectifier;

b. MP column which is supplied liquid $N_2$ overhead reflux from the HP rectifier overhead, and with means for $N_2$ vapor withdrawal overhead;

c. at least one $N_2$ expander for maintaining a backpressure on the MP column, said expander being connected to said means for $N_2$ vapor withdrawal;

d. LP column including bottoms reboiler supplied with heat from the HP rectifier overhead vapor;

e. means for refluxing LP column overhead by at least one of i. latent heat exchange with kettle liquid from said HP rectifier or ii. latent heat exchange with MP column intermediate height liquid;

f. means for withdrawing crude argon from LP column overhead; and g. reboiler for MP column bottom liquid which is supplied latent heat from partial condensation of the supply air.

12. Apparatus according to claim 11 further including means for exchanging latent heat from an intermediate height of the LP column to an intermediate height of the MP column.

13. Apparatus according to claim 12 further including argon stripping sections in the bottom sections of both of said LP and MP columns, and means for transferring sidestream liquid from said MP column to said LP column.

14. Apparatus according to claim 12 further including means for gasifying liquid oxygen by total condensation of a fraction of the supply air.

15. Apparatus according to claim 14 further including means to split said condensed air into one stream which is directly injected into said MP column and a second stream which is used for indirect refluxing of said LP column.

16. Apparatus according to claim 12 further including means to split the $N_2$ withdrawn from the MP column and a second expander for the split stream which oeprates at a different temperature than said first expander.

* * * * *